United States Patent [19]

Jackson

[11] Patent Number: 4,467,307

[45] Date of Patent: Aug. 21, 1984

[54] PRESSURE-OPERATED SWITCH FOR A HIGH-VOLTAGE INTERRUPTING MODULE

[75] Inventor: Hiram S. Jackson, Skokie, Ill.

[73] Assignee: S&C Electric Company, Chicago, Ill.

[21] Appl. No.: 524,181

[22] Filed: Aug. 17, 1983

[51] Int. Cl.[3] ..... H01H 39/00

[52] U.S. Cl. ..... 337/30; 337/221; 337/401

[58] Field of Search ..... 337/4, 6, 30, 35, 143, 337/158, 159, 161, 162, 401, 409

[56] References Cited

U.S. PATENT DOCUMENTS

| | | | |
|---|---|---|---|
| 3,118,986 | 1/1964 | Lewis et al. | 337/409 X |
| 3,239,631 | 3/1966 | Snell | 337/30 |
| 3,291,937 | 12/1966 | Carothers et al. | 337/30 |

*Primary Examiner*—George Harris

*Attorney, Agent, or Firm*—John D. Kaufmann

[57] ABSTRACT

An improved switch for a high-voltage device in which ignition of a power cartridge moves an insulative piston located in a conductive member, into a passageway formed in an insulative liner, said piston moving a contact through the passageway and away from the conductive member to break an electrical interconnection between the conductive member and the movable contact and to form a gap therebetween, thereby opening the switch; the bore and the passageway being aligned, the piston being made of a material which is more rigid and less easy to deform than the material of the liner upon the application, at a given rate, of a given load, and the size of the piston being greater than the size of the passageway.

17 Claims, 3 Drawing Figures

PRESSURE-OPERATED SWITCH FOR A HIGH-VOLTAGE INTERRUPTING MODULE

BACKGROUND OF THE INVENTION

Field of the Invention

The present invention relates to an improved pressure-operated switch for a high-voltage interrupting module. More specifically, the present invention relates to an improvement of the switches, disclosed in commonly assigned U.S. Pat. Nos. 4,342,978, issued Aug. 3, 1982 in the name of Meister, and 4,370,531, issued Jan. 25, 1983 in the name of Tobin, and in the following commonly assigned U.S. patent applications: Ser. No. 179,367, filed Aug. 18, 1980 (now abandoned in favor of continuation application Ser. No. 550,201, filed Nov. 9, 1983) in the name of Jarosz and Panas; Ser. No. 179,366, filed Aug. 18, 1980 (now abandoned in favor of continuation application Ser. No. 539,396, filed Oct. 6, 1983) which issued Jan. 24, 1984 as U.S. Pat. No. 4,427,963, and Ser. No. 437,926, both filed Nov. 1, 1982 in the names of Jarosz and Panas.

Prior Art

The above patents and patent applications relate to various aspects of a pressure-operated switch and to a high-voltage interrupting module containing the switch. The switch may include a pair of contacts, which are normally electrically interconnected, for example, by direct abutment therebetween or, preferably, by interconnecting them with a shearable or tearable metallic disc or membrane. In preferred embodiments of the switch, one contact is stationary, while the other is movable, although both may be movable. The contacts are separable by relative movement apart along a fixed line of direction to open a gas therebetween, thereby opening the switch. One of the contacts, preferably the stationary contact, contains a bore which, in conjunction with a piston or trailer positioned between the movable contact and the bore, defines a closed chamber. The chamber houses a power cartridge or similar pressure-generating device.

The switch may be in electrical shunt with a fuse, a fusible element of which, as well as the switch, preferably reside within a common housing. When the switch is closed (i.e., when the contacts thereof are electrically interconnected), the resistance of the current path through the switch is much lower than the resistance of the current path through the fusible element, and, accordingly, a majority of the current flowing through the module flows through the switch. Thus, the module has a very high continuous current rating. Upon opening the switch, the contacts separate and current is rapidly commutated from the switch to the fusible element where it is interrupted. Separation of the contacts is achieved by igniting the power cartridge, which evolves high pressure within the chamber. This high pressure acts against the piston and the forces produced thereby rapidly drive the piston and the movable contact away from the stationary contact, which shears the disc to break the normal electrical interconnection and open the switch. The power cartridge may be ignited in response to a trip signal produced by apparatus which senses a fault current or other over-current in a circuit in which the interrupting module is connected for protection thereof. Such trip-signal-producing apparatus may be that which is disclosed in commonly assigned U.S. patent application Ser. Nos. 506,942; 506,943; and 506,944, all filed June 22, 1983 in the name of Ruta.

In specific embodiments of the switch described in the above patents and patent applications, a secondary stationary contact is included. When the switch is closed, the movable contact and the second stationary contact are electrically interconnected with a second shearable disc. When the power cartridge is ignited, movement of the movable contact also shears the second disc. As the movable contact moves away from the first stationary contact, it is telescoped into a bore formed in the second stationary contact. This bore may be lined with an insulative sleeve and the movable contact may be covered with an insulative sleeve, so that such telescoping results in the formation of a second gap between the movable contact and the second stationary contact.

The movable contact moves rapidly away from the first stationary contact through a passageway in an insulative liner, which the piston may also enter. The piston also enters the passageway in the liner to physically isolate the moving contact and the second stationary contact from the ignition products of the power cartridge. This isolation prevents or suppresses the formation of any arc between the separating contacts and between the stationary contacts. In preferred embodiments of the switch, the stationary contacts and the liner are engageably surrounded, and have their relative positions fixed, by an insulative housing, which maintains the stationary contacts and the liner end-to-end with the bores and the passageway axially aligned.

Tests of earlier versions of the switch (such as those disclosed in the '978 and '531 patents and in the '367 and '366 applications) showed that, after the piston entered the liner, some of the ignition products of the power cartridge might, in some cases, flow along the piston-liner interface. Such flow could create the possibility of internal flashover of the open switch, i.e., undesired conduction within the open switch between the stationary contacts. On the assumption that such flow was caused by abrasion or distortion of the piston or the liner (or both) as the switch opened, both elements were made of abrasion-resistant, high surface lubricity, non-brittle, ultra high molecular weight polyethylene (UHMWPE), as disclosed in the '926 application. Tests of later versions of the switch showed that this ignition-product-flow problem, though ameliorated by the UHMWPE piston and liner, nevertheless could, in some cases, remain.

Specifically, if manufacturing tolerances led to the passageway of the UHMWPE liner being too large or to the UHMWPE piston being too small, there could be sufficient clearance therebetween to permit flow of the ignition products therepast. Such flow could produce a conductive path between the first stationary contact and the second stationary contact. Additionally, if the UHMWPE piston were intentionally oversized so that its rapid entry into the UHMWPE liner constituted a conformal force fit, at times either the switch might fail to fully open due to jamming of the piston in the liner, or if it did open, either such opening could be too slow (due to high friction between the piston and the liner) to properly commutate current to the fusible element or the piston or liner could become sufficiently deformed to allow the undesirable ignition product flow.

It is a primary object of the present invention to eliminate the abovedescribed problems which might occur in the switches of the above patents and patent applications.

SUMMARY OF THE INVENTION

With the above and other objects in view, the present invention contemplates an improved switch for a high-voltage device. The switch improved hereby is of the general type in which ignition of a power cartridge moves an insulative piston, which is normally located in a bore formed in a conductive member, away therefrom and into a passageway formed in an insulative liner. The movement of the piston moves a movable contact through the passageway and away from the conductive member to break an electrical interconnection between the conductive member and the movable contact. This forms a gap between the conductive member and the movable contact and opens the switch. The bore and the passageway are aligned.

In the improved switch, the piston is made of a material which is more rigid and less easy to deform than the material of the liner upon the application, at a given rate, of a given load. Further, the size of the piston is greater than the size of the passageway. In preferred embodiments, the piston is made of a low density thermoplastic such as polymethylpentene, and the liner is made of ultra high molecular weight polyethylene. The piston is sufficiently larger than the passageway so that as, and after, the piston is intimately and conformally telescoped into the liner in a force fit manner, the dielectric strength of the gap is and remains high. Further, the relative sizes of the piston and the passageway prevent passage of the ignition products of the power cartridge along the interface between the piston and the liner.

In specific embodiments, the bore, the passageway, the piston and the movable contact have circular cross-sections and the diameter of the piston is equal to, or smaller, than the diameter of the bore while being larger than the diameter of the passageway. The diameters of the piston and of the passageway may be selected so that entry of the piston into the passageway tends to deform the liner outwardly. Where the switch is of the type which further includes an insulative housing which engageably surrounds, holds and fixes the relative positions of the conductive member and the liner, this outward deformation of the liner increases the engagement between the housing and the liner to prevent passage of the ignition products of the power cartridge along the interface therebetween.

DETAILED DESCRIPTION

Figure 1:
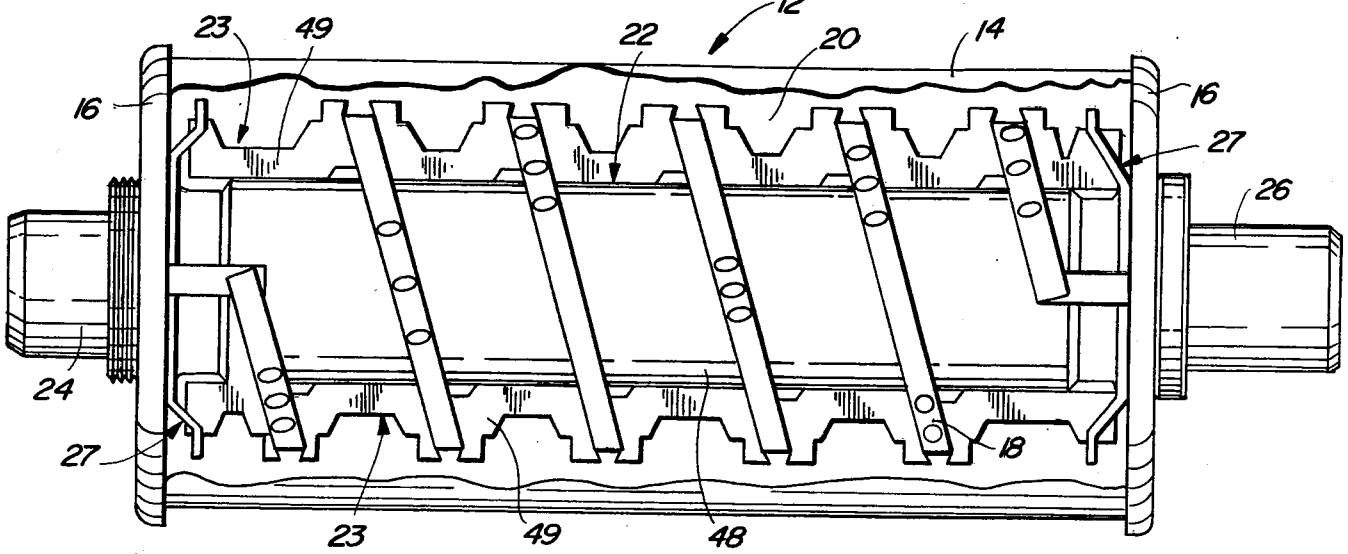
FIG. 1 is a front elevation of a portion of an interrupting module which includes an improved switch according to the present invention.

The present invention is used with an interrupting module 12. Because the module 12 is more completely described in the above U.S. patents and patent applications, it is only generally depicted in the drawing hereof and only generally described herein.

Referring to FIG. 1, the module 12 includes a generally cylindrical open-ended insulative housing 14, which is closed by end plates 16. The housing and end plates 14 and 16 surround a fusible element 18 helically wound around a central axis of the housing 14 and may also surround a mass of a particulate fulgurite-forming medium, such as silica sand. The silica sand is in intimate engagement with the fusible element 18. The fusible element 18, which may be silver or copper, and the sand 20 interrupt fault currents or other over-currents therethrough in a current-limiting or energy-limiting manner, according to well-known principles. The fusible element 18 may be similar to those disclosed in commonly assigned U.S. Pat. No. 4,359,708, issued Nov. 16, 1982 or U.S. patent application No. 437,776 filed Oct. 29, 1982, both in the names of Jarosz and Panas.

The housing 14 also surrounds a switch 22 around which the fusible element 18 may be maintained in its helical configuration by insulative supports 23, such as those disclosed in commonly assigned U.S. patent application Ser. No. 181,603, filed Aug. 27, 1980 in the names of Jarosz and Panas.

Figure 2:
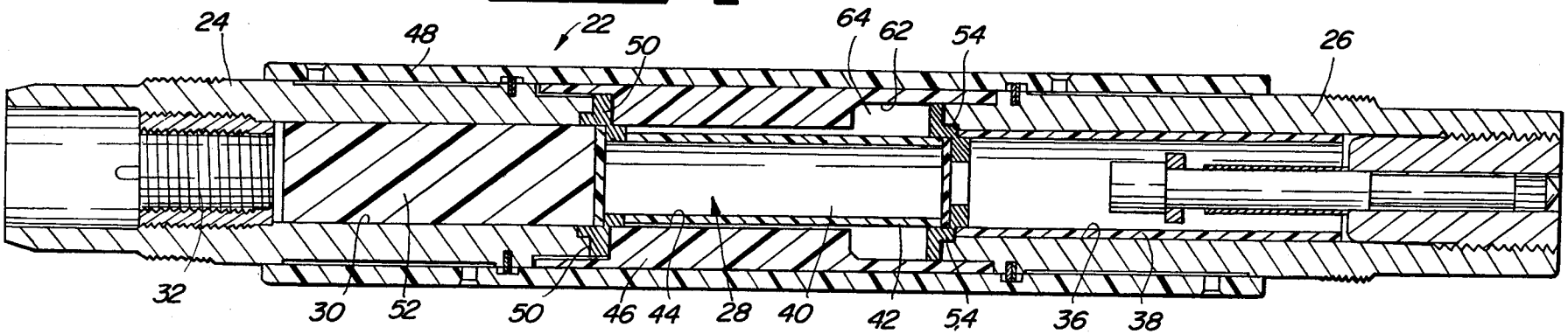
FIG. 2 is a partially sectioned front elevation of a portion of FIG. 1 which shows in greater detail the improved switch hereof in the closed position.

The switch 22, which is improved by the present invention, may be generally constructed in accordance with the above U.S. patents and patent applications and an example thereof is depicted in FIGS. 1 and 2. Specifically, the switch 22 includes a first conductive member 24, to which the left end plate 16 is attached, and a second conductive member 26 to which the right end plate 16 is attached. The first conductive member 24 serves as a first stationary contact of the switch 22, while the second conductive member 26 serves as a second stationary contact of the switch 22. The ends of the fusible element 18 may be rendered electrically continuous with the stationary contacts 24 and 26 by facilities 27 described more fully in commonly assigned U.S. patent application Ser. No. 439,444, filed Nov. 5, 1982 in the name of Jarosz.

Figure 3:
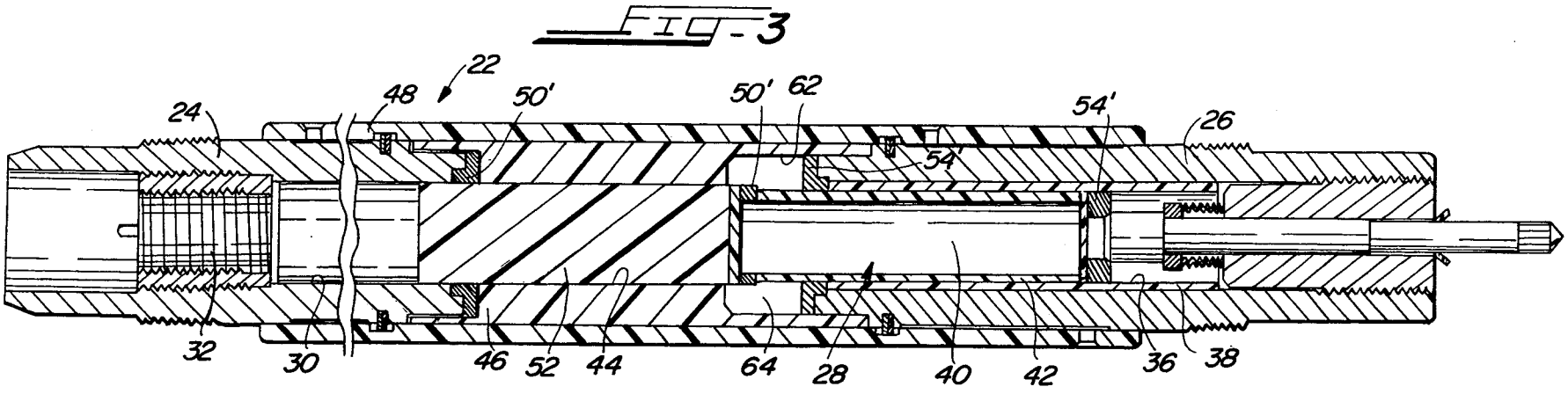
FIG. 3 shows the switch of FIG. 2 in the open position.

The switch 22 also includes a movable contact 28 (FIGS. 2 and 3). Normally, the movable contact is electrically continuous with both stationary contacts 24 and 26 so that a continuous low-resistance electrical path is formed between the members 24 and 26 via the movable contact 28. Because the resistance of this path is lower than the resistance of the fusible element 18, while the switch 22 is closed, as depicted in FIG. 2, the majority of the current flowing through the module 12 is normally shunted through the switch 22 and away from the fusible element 18. When the switch 22 opens, as described below, the current formerly flowing through the stationary contacts 24 and 26 and the movable contact 28 is commutated to the fusible element 18 for interruption.

As shown in FIG. 2, the first stationary contact 24 has a central bore 30. At the left end of the central bore 30, a power cartridge 32 or other pressure-generating device is located. The second stationary contact 26 also contains a central bore 36. This bore 36 may be lined with an insulative sleeve 38.

The movable contact 28 comprises a conductive member 40 surrounded by an insulative sleeve 42. The movable contact 28 is normally located between the stationary contacts 24 and 26 and within a passageway 44 formed through an insulative liner 46 between the stationary contacts 24 and 26.

The stationary contacts 24 and 26 with the liner 46 are held with the bores 30 and 36 and the passageway 44 aligned therebetween by an insulative housing 48 which engageably surrounds the stationary contacts 24 and 26 which are affixed thereto in a convenient manner. If desired, the liner 46 may be attached to the stationary contacts 24 and 26 in accordance with the invention disclosed in commonly assigned and filed U.S. patent application Ser. No. 525,516, filed Aug. 22, 1983 in the name of Swanson, and the stationary contacts 24 and 26 may be affixed to the housing 48 pursuant to commonly assigned and filed U.S. patent application Ser. No. 524,180, filed Aug. 17, 1983 in the names of Jackson and Scherer. As shown in FIG. 1, the insulative support 23 may comprise a pair of notched fins 49, and the fusible element 18 may be helically maintained about the housing 48 by the fins 49, as described in commonly assigned U.S. patent application Ser. No. 181,603, filed Aug. 27, 1980 in the names of Jarosz and Panas.

With the movable contact 28 occupying the position shown in FIG. 2, the conductive member 40 thereof is electrically interconnected to the stationary contact 24 by a conductive shear disc 50 or other metallic diaphragm or member, which is shearable, tearable or the like. To the left of the diaphragm 50 is located an insulative piston or trailer 52. In the normal position of the movable contact 28 shown in FIG. 2, the piston 52 normally occupies the bore 30 in the first stationary contact 24 and the movable contact 28 occupies the passageway 44 in the liner 46.

The right end of the conductive member 40 is normally electrically interconnected to the second stationary contact 26 by a shear disc 54, which may be similar to the shear disc 50. The interior of the insulative sleeve 38 is sufficiently large to receive the conductive member 40 with its insulative sleeve 42 thereon. The passageway 44 of the liner 46 can receive both the conductive member 40 with the insulative sleeve 42 thereon and the trailer 52.

In preferred embodiments, the bores 30 and 36, the passageway 44, the movable contact 28 and the interior of the sleeve 38 all have circular cross-sections.

In the normal condition of the module 12, as shown in FIG. 2 and as previously described, the switch 22 carries a majority of the current flowing in a protective high-voltage circuit (not shown) to which the module 12 is connected. This current flows through the stationary contacts 24 and 26, the discs 50 and 54, and the movable contact 28. Little current normally flows through the fusible element 18. Should a fault current or other over-current occur in the protective circuit (not shown) to which the module 12 is connected, apparatus (not shown) detects this condition and ignites the power cartridge 32. Ignition of the power cartridge 32 causes it to evolve large quantities of high-pressure gas which acts on the left end of the piston 52. The force applied to the piston 52 by the high pressure moves the piston 52 rightwardly and also moves rightwardly the movable contact 28 (i.e., the conductive member 40 with the insulative sleeve 42 thereon). Rightward movement of the piston 52 and of the movable contact 28 severs, rips or tears the discs 50 and 54, thereby breaking the electrical interconnection between the movable contact 28, on the one hand, and both stationary contacts 24 and 26, on the other hand, as shown in FIG. 3. The shearing of the discs 50 and 54 produces two portions 50'-50' and 54'-54' thereof. Two gaps are thereby opened by the switch 22. The first gap exists between the left end of the conductive member 40 and the right end of the first stationary contact 24, while the second gap exists between the right end of the conductive member 40 and the left end of the second stationary contact 26. Both gaps are electrically insulated. Specifically, the first gap is electrically insulated by the reception of the piston 52 within the passageway 44 in the liner 46. The second gap is electrically insulated by the reception of the insulative sleeve 42 within the bore 36 of the insulative sleeve 38. The reception of the piston 52 by the passageway 44 in the liner 46 is also intended to isolate the movable contact 28 and the stationary contact 26 from the ignition products of the power cartridge 32, which may contain electrically conductive, arc-promoting materials.

When the switch 22 opens (FIG. 3), the current previously flowing therethrough is commutated to the fusible element 18. The action of the fusible element 18 and of the silica sand 20 (FIG. 1) ultimately extinguishes this current, as is well known.

After numerous experiments with the module 12 as described above, it was found that after the switch 22 opened, the ignition products of the power cartridge 32 could, in some cases, flow along the interface between the piston 52 and the liner 46. Because these ignition products contain conductive elements and are hot, such flow might, at times, reinitiate current conduction between the stationary contacts 24 and 26 after interruption thereof by the fusible element 18 (defeating successful interruption).

According to the present invention, selection of proper materials for the piston 52 and the liner 46 and selection of appropriate dimensions for the piston 52 and the passageway 44 of the liner 46 can result in restriction or elimination of the above noted flow of ignition products. Specifically, the liner 46 is made of a material exhibiting good abrasion-resistance, high surface lubricity and lack of brittleness. A preferred material for the liner 46 is ultra high molecular weight polyethylene (UHMWPE), as set forth in the '926 application. The piston 52 is made of a material which is more rigid and harder to deform than the material of the liner 46. Preferably, the material of the piston 52 is polymethylpentene, sold under the tradename TPX by Mitsui Petrochemical Industries, Ltd. TPX (4-methylpentene-1-based polyolefin) is a thermoplastic having a high melting point (240° C.), excellent electrical insulating properties, excellent anti-tracking properties the lowest dielectric constant of all known synthetic resins, and the lowest density (83 g/CM3) of any commercially available thermoplastic. It has been found that TPX acts more rigidly and is more resistant to deformation than UHMWPE with a given rate of application of a given load. As a consequence, it has also been found that entry of the piston 52 into the passageway 44 of the liner 46 results in the liner 46 being easily pushed aside by the piston 52 to permit such entry to occur rapidly and without significant loss of the kinetic energy of the piston-contact combination 52-28.

Because of the relative hardnesses of TPX and UHMWPE, it has additionally been found that the diameter of the TPX piston 52 may be selected to be larger than the diameter of the passageway 44 of the UHMWPE liner 46. Consequently, entry of the piston 52, into the passageway 44 produce a conformal force fit therebetween which positively restricts the flow of the ignition products along the interface therebetween. This force fit also outwardly deforms the less rigid liner 46, increasing the engagement between it and the housing 48 to restrict flow along the interface therebetween. Further, the force fit of the piston 52 in the liner 46 ensures that the dielectric strength of the first gap—between the movable contact 28 and the stationary contact 24—is and remains at a high level as the contacts 24 and 28 separate. Consequently, the stationary contacts 24 and 26 are separated by a solid high dielectric strength structure, namely, the piston 52 force fitted into the liner 46. Thus, higher currents at higher voltages may be successfully commutated from the switch 22 to the fusible element 18.

The low density of TPX permits increased acceleration of the piston-contact combination 52-28 by a given power cartridge 32 relative to the acceleration of such a combination having a higher density piston 52. The thermal and electrical properties of TPX are well suited to use in the switch 22. The relative rigidities of the materials of the piston 52 and the liner 46 lead to movement of the piston 52 through the liner 46 which is similar to movement of a nail through wood. The use of TPX for the piston 52 is to be contrasted with the use of UHMWPE therefor, as shown in the '926 application. With both the piston 52 and the liner 46 made of UHMWPE, opening of the switch 22 may not, in some cases, be complete or the ignition products may, in some cases, flow along the piston-liner 52-46 interface, or both effects may occur. Specifically, with the diameter of a UHMWPE piston 52 larger than that of the passageway 44 of an UHMWPE liner 46 (intentionally, or due to manufacturing tolerances), the piston 52 may jam in the passageway 44, preventing full or rapid movement of the contact 28; if fill or near full movement of the contact 28 occurs, the piston 52 or the passageway 44 or both may be deformed by the rapid entry of the piston 52 into the passageway 44. If the diameter of a UHMWPE piston 52 is decreased so as to have a clearance, sliding fit with the passageway 44 of a UHMWPE liner 46, the ignition products may flow along the interface therebetween. As noted, the oversized TPX piston 52 easily enters and moves in the passageway 44, pushing aside the UHMWPE of the liner 46 without jamming so that the interference fit therebetween resists flow of the ignition products and maintains the dielectric strength of the first gap between the contacts 24 and 26 at a high level.

In specific examples, the diameters of the bore 30, of the passageway 44, and of the piston 52 for a switch 22 usable at 5 to 38 kv may be within several thousandths of an inch of 0.750 inch, with the diameter of bore 30 exceeding the diameter of piston 52 and the diameter of piston 52 exceeding the diameter of passageway 44.

As set forth in the '926 application, the passageway 44 of the liner 46 may be relieved, undercut or diametrically increased in size, as shown at 62. This provides a relief cavity or volume 64. Should interruption of a fault current or other over-current by the fusible element 18 generate sufficient heat to cause undue expansion of the liner 46 or the piston 52, the relief cavity or volume 64 provides a space into which the material of these elements can expand. Such expansion into the relief cavity or volume 64 prevents outward forces or pressure from being applied to the housings 14 and 48, to the end plates 16, and to the stationary contacts 24 and 26, thus ensuring that the module 12 remains integral during and following operation thereof.

As set forth in commonly assigned U.S. patent application Ser. No. 525,205, filed Aug. 22, 1983 in the name of Swanson, a lip seal (not shown) may be included at or on the end of the piston 52 of the present invention to sealingly engage the bore 30 of the stationary contact 24.

With these advantages and features in mind, it should be apparent that various changes, alterations, and modifications may be made to the preferred embodiment of the present invention as described herein, without departing from the spirit and scope of the present invention as defined in the appended claims.

I claim:

1. An improved switch for a high-voltage device; the switch being of the type in which ignition of a power cartridge moves an insulative piston, which is normally located in a bore formed in a conductive member, away therefrom and into a passageway formed in an insulative liner, such movement of the piston moving a movable contact through the passageway and away from the conductive member to break an electrical interconnection between the conductive member and the movable contact and to form a gap therebetween, thereby opening the switch; the bore and the passageway being aligned; wherein the improvement comprises:

the piston being made of a material which is more rigid and less easy to deform than the material of the liner upon the application, at a given rate, of a given load, and the size of the piston being greater than the size of the passageway.

2. An improved switch as in claim 1, wherein the piston is made of a low density thermoplastic.

3. An improved switch as in claim 2, wherein the piston is made of polymethylpentene.

4. An improved switch as in claim 3, wherein the liner is made of ultra high molecular weight polyethylene.

5. An improved switch as in claim 2, wherein the liner is made of ultra high molecular weight polyethylene.

6. An improved switch as in claim 1, wherein the piston is sufficiently larger than the passageway so that, as and after the piston is intimately and conformally telescoped into the liner in a force fit manner, the dielectric strength of the gap is and remains high and passage of the ignition products of the power cartridge along the interface between the piston and the liner is prevented.

7. An improved switch as in claim 6, wherein the piston is made of polymethylpentene.

8. An improved switch for a high-voltage device; the switch being of the type in which ignition of a power cartridge moves an insulative piston which is normally located in a bore formed in a conductive member, away therefrom and into a passageway formed in an insulative liner, such movement of the piston moving a movable contact through the passageway and away from the conductive member to break an electrical interconnection between the conductive member and the movable contact and to form a gap therebetween, thereby opening the switch; the bore and the passageway being aligned; wherein the improvement comprises:

the piston being made of polymethylpentene.

9. An improved switch as in claim 8, wherein the bore, the passageway, the piston and the movable contact have circular cross-sections, and the diameter of the piston is equal to, or smaller, than the diameter of the bore and is larger than the diameter of the passageway.

10. An improved switch as in claim 9, wherein the diameter of the piston is sufficiently larger than the diameter of the passageway so that upon entry of the piston thereinto, the piston and the liner intimately, conformally engage in a force fit manner to prevent passage of the ignition products of the power cartridge along the interface therebetween and to maintain the dielectric strength of the gap at a high level.

11. An improved switch as in claim 10, wherein the entry of the piston into the passageway tends to deform the liner outwardly.

12. An improved switch as in claim 11, the switch being of the type which further includes an insulative housing engageably surrounding, holding and fixing the relative positions of the conductive member and the liner, wherein the outward deformation of the liner effected by the entry of the piston into the passageway increases the engagement between the housing and the liner to prevent passage of the ignition products of the power cartridge along the interface therebetween.

13. An improved switch for a high-voltage device; the switch being of the type in which ignition of a power cartridge moves an insulative piston, which is normally located in a first bore formed in a first stationary contact, away therefrom and into a passageway formed in an insulative liner, such movement of the piston moving a movable contact through the passageway and into a second bore formed in a second stationary contact, such movement of the movable contact breaking electrical interconnections between the stationary contacts and the movable contact to form respective first and second gaps, thereby opening the switch; the bores and the passageway being aligned; wherein the improvement comprises;

the piston being made of a material which is more rigid and less easy to deform than the material of the liner upon the application, at a given rate, of a given load, and the size of the piston being greater than the size of the passageway.

14. An improved switch as in claim 13, wherein the piston is made of a low density thermoplastic having a low coefficient of surface friction.

15. An improved switch as in claim 14, wherein the piston is made of polymethylpentene.

16. An improved switch as in claim 15, wherein the liner is made of ultra high molecular weight polyethylene.

17. An improved switch as in claim 13, wherein the size of the piston is sufficiently larger than the size of the passageway so that upon entry of the piston thereinto, the piston and the liner intimately, conformally engage in a force fit manner to prevent passage of the ignition products of the power cartridge along the interface therebetween, to isolate the second stationary contact and the movable contact from the ignition products, and to maintain the dielectric strength of the first gap at a high level.

* * * * *

UNITED STATES PATENT AND TRADEMARK OFFICE

CERTIFICATE OF CORRECTION

PATENT NO. : 4,467,307

DATED : August 21, 1984

INVENTOR(S) : Hiram S. Jackson

It is certified that error appears in the above-identified patent and that said Letters Patent is hereby corrected as shown below:

Col. 1, line 19, after "1983)" insert --in the name of O'Leary, and Serial No. 437,925--

Col. 1, line 36, "gas" should be --gap--

Col. 2, line 4, "secondary" should be --second--

Col. 2, line 68, "abovedescribed" should be --above-described--

Col. 4, line 37, after "contact" insert --28--

Col. 5, line 45, "protective" should be --protected--

Col. 7, line 27, "fill" should be --full--

Signed and Sealed this

*Twelfth* Day of *February 1985*

[SEAL]

*Attest:*

DONALD J. QUIGG

*Attesting Officer* *Acting Commissioner of Patents and Trademarks*